United States Patent [19]

Ando et al.

[11] 4,337,165

[45] Jun. 29, 1982

[54] AMINE OXIDE-AND ALKALI METAL CHLORIDE-CONTAINING NON-CORROSIVE LIQUID DETERGENT COMPOSITION

[75] Inventors: Hideo Ando, Tokyo; Akira Hayashi, Sakura; Haruo Ohkouchi; Kyozo Kitano, both of Chiba, all of Japan

[73] Assignee: Lion Corporation, Tokyo, Japan

[21] Appl. No.: 216,290

[22] Filed: Dec. 15, 1980

[30] Foreign Application Priority Data

Dec. 18, 1979 [JP] Japan ..... 54-164356

[51] Int. Cl.[3] ..... C11D 1/83; C11D 7/10

[52] U.S. Cl. ..... 252/105; 252/528; 252/545; 252/547; 252/551; 252/554; 252/555; 252/558

[58] Field of Search ..... 252/532, 536, 545, 547, 252/528, 526, 558, 539, 389 A, 395, 400 A, 406, 105, DIG. 14

[56] References Cited

U.S. PATENT DOCUMENTS

| | | | |
|---|---|---|---|
| 2,394,321 | 2/1946 | McGhie | 252/389 X |
| 2,901,438 | 8/1959 | Rogers | 252/387 |
| 2,999,068 | 9/1961 | Pilcher et al. | 252/528 |
| 3,297,577 | 1/1967 | Standish et al. | 252/70 |
| 3,887,488 | 6/1975 | Scott et al. | 252/389 A |
| 3,970,596 | 7/1976 | Klisch et al. | 252/546 |
| 4,070,309 | 1/1978 | Jacobsen | 252/547 |
| 4,268,406 | 5/1981 | O'Brien et al. | 252/105 |
| 4,295,985 | 10/1981 | Petrow et al. | 252/105 |

FOREIGN PATENT DOCUMENTS

| | | |
|---|---|---|
| 242248 | 12/1962 | Australia . |
| 914701 | 1/1963 | United Kingdom . |

*Primary Examiner*—P. E. Willis, Jr.

*Attorney, Agent, or Firm*—Armstrong, Nikaido, Marmelstein & Kubovcik

[57] ABSTRACT

A liquid detergent composition is provided which contains, based on the total weight of the composition, 5–40 wt. % of an anionic surface active agent, 1–10 wt. % of an amine oxide, 0.5–5 wt. % of an alkali metal halide and 0.04–1.5 wt. % of at least one inorganic salt selected from sulfites, phosphates and thiosulfates. The liquid detergent composition does not corrode a manufacturing apparatus and is excellent in detergency and is mild to the skin.

6 Claims, No Drawings

AMINE OXIDE-AND ALKALI METAL CHLORIDE-CONTAINING NON-CORROSIVE LIQUID DETERGENT COMPOSITION

BACKGROUND OF THE INVENTION

1. Field of the Invention

The present invention relates to a liquid detergent composition which exhibits an enhanced detergency and is mild to the skin and, furthermore, which does not corrode the apparatus used for the manufacture thereof.

2. Description of the Prior Art

Of liquid detergents, those often brought into contact with the skin at the time of application, for example, detergents for washing tablewares or hair, are required to be mild to the skin. Accordingly, a mono-long-chain-alkylamine oxide which by itself is mild to the skin is popularly used as a surface active agent for such liquid detergents. However, this amine oxide is poor in detergency, and therefore, this amine oxide is ordinarily used in combination with an anionic surface active agent or the like.

Liquid detergents are also required to have a good storage stability. More specifically, liquid detergents should preferably have such properties that a homogeneous solution state can be retained even if temperature varies to a considerable extent, and that even if such homogenous solution is frozen at low temperatures, the homogeneous solution state can easily be restored if the temperatures are elevated to normal temperatures. Furthermore, it is preferable that no film be formed on the liquid surface falling in contact with the gas phase even if such liquid detergent is allowed to stand for a relatively long time in an open vessel. Moreover, it is preferable that liquid detergents should always retain an appropriate viscosity. It is known that alkali metal halides such as sodium chloride and potassium chloride are effective for improving the storage stability of liquid detergents.

Accordingly, it is expected that a liquid detergent which exhibits an enhanced detergency and is mild to the skin and has a good storage stability will be obtained by incorporating a mono-long-chain-alkylamine oxide and an alkali metal halide with an appropriate anionic surface active agent. Based on this expectation, we tried to prepare a liquid detergent containing the above-mentioned three components. To our great surprise, it has been found that the manufacturing apparatus used for the preparation of such detergent become corroded. Liquid derergents are oridinarily prepared by uniformly mixing ingredients in a stainless steel mixer. If a mono-long-chain-alkylamine oxide and an alkali metal halide are simultaneously made present in such a mixer formed of ordinarily used stainless steel, the mixer is corroded. This corrosion is not caused if any one of the amine oxide and alkali metal halide is not present.

SUMMARY OF THE INVENTION

It is, therefore, a primary object of the present invention to provide a liquid detergent composition which does not corrode a mixer or other manufacturing apparatuses even though it contains a mono-long-chain-alkylamine oxide and an alkali metal halide.

Other objects and advantages of the present invention will be apparent from the following description.

In accordance with the present invention, there is provided a liquid detergent composition comprising 5 to 40% by weight of an anionic surface active agent, 1 to 10% by weight of an amine oxide, 0.5 to 5% by weight of an alkali metal halide and 0.04 to 1.5% by weight of at least one inorganic salt selected from the group consisting of sulfites, phosphates and thiosulfates.

DESCRIPTION OF THE PREFERRED EMBODIMENTS

In the liquid detergent composition of the present invention, as the anionic surface active agent, there are preferably used sulfonic acid salts of olefins having 10 to 20 carbon atoms such as α-olefins, internal olefins and vinylidene type olefins; polyoxyethylene alkyl ether sulfates ($\bar{p}=0.5$ to 10) containing an alkyl group having 8 to 18 carbon atoms; alkylbenzene sulfonates containing an alkyl group having 9 to 15 carbon atoms; and alkane-sulfonic acid salts having 10 to 20 carbon atoms. It is preferable that these salts be in the form of a sodium, potassium, magnesium or triethanolamine salt. Since the anionic surface active agent is the main component exerting detergency in the liquid detergent composition of the present invention, the anionic surface active agent should occupy 5 to 40% by weight, preferably 10 to 35% by weight, based on the total weight of the composition.

The amine oxide that is used in the present invention is preferably a mono-long-chain-alkylamine oxide represented by the following formula:

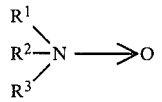

wherein $R^1$ stands for a linear or branched alkyl group having 10 to 20 carbon atoms, and $R^2$ and $R^3$ each stand for a methyl or ethyl group. Ordinarily, each of $R^2$ and $R^3$ in the above general formula is a methyl group. As the amine oxides of this type, there can be mentioned, for example, lauryldimethylamine oxide, lauryldiethylamine oxide, myristyldimethylamine oxide, myristyldiethylamine oxide, palmityldimethylamine oxide, stearyldimethylamine oxide, coconut-alkyl-dimethylamine oxide and hardened beef talloalkyldimethylamine oxide. Such long-chain-alkylamine oxides exerts a function to moderate the skin-irritating property of the liquid detergent. In the present invention, the long-chain-alkylamine oxide is incorporated in an amount of 1 to 10% by weight based on the total weight of the composition.

The alkali metal halide used has a function of improving storage stability of the liquid detergent. The alkali metal halide includes, for example, sodium chloride and potassium chloride, and is incorporated in an amount of 0.5 to 5% by weight based on the total weight of the composition.

The main feature of the present invention resides in the incorporation of an inorganic salt such as a sulfite, a phosphate or a thiosulfate as a corrosion inhibitor in the detergent composition. Preferable inorganic salts are alkali metal sulfites, phosphates and thiosulfates, such as, for example, $NaHSO_3$, $Na_2SO_3$, $KHSO_3$, $K_2SO_3$, $NaH_2PO_4$, $Na_2HPO_4$, $Na_3PO_4$, $KH_2PO_4$, $K_2HPO_4$, $K_3PO_4$, $Na_2S_2O_3$ and $K_2S_2O_3$. The inorganic salt acting as the corrosion inhibitor should already be present in a mixer at the time the mono-long-chain-alkylamine oxide and the alkali metal halide are first made co-present in the mixer. The inorganic salt is incorporated in an amount of 0.04 to 1.5% by weight, preferably 0.04 to 0.5% by weight, based on the total weight of the composition. If the amount of the inorganic salt is smaller than 0.04% by weight, the desired corrosion-preventing effect cannot be achieved, and if the amount of the inorganic salt exceeds 1.5% by weight, the storage stability and perfume of the liquid detergent composition are adversely influenced. The inorganic salt may be incorporated either in the form of an aqueous solution or in the form of an anhydrous salt or a hydrate.

Since the liquid detergent composition of the present invention contains not only an anionic surface active agent but also a mono-long-chain-alkylamine oxide, the composition is excellent in detergency and is mild to the skin. Furthermore, since the liquid detergent composition of the present invention contains an alkali metal halide, the composition has a very good storage stability. Moreover, since the liquid detergent composition of the present invention contains an inorganic salt as a corrosion inhibitor, a mixer used for the preparation of the liquid detergent composition is not corroded at all, and even when the prepared liquid detergent composition is stored in a vessel formed of, for example, a 18Cr-8Ni stainless steel (SUS 304), the vessel is not corroded at all.

Known additives such as soaps, nonionic surface active agents, amphoteric surface active agents, hydrotropes, lower alcohols, coloring agents, perfumes, fungicides and mildew-proofing agents may be incorporated into the liquid detergent composition of the present invention, if desired.

The invention will be further illustrated by the following example.

EXAMPLE

As the anionic surface active agent, there were used sodium $C_{14}$-α-olefin-sulfonate (hereinafter referred to as "AOS") (pH=7.0) and sodium polyoxyethylene alkyl sulfate (hereinafter referred to as "AES") (pH=7.0) (the carbon number of the alkyl group being 12 to 13, the linearity being 80% and the average mole number of added ethylene oxide being 3 or 5). As the amine oxide, there was used dodecyldimethylamine oxide (hereinafter referred to as "AAO") (pH=7.0), and as the alkali metal halide, there was used potassium chloride. The amine oxide and alkali metal halide were added to an aqueous solution of the anionic surface active agents, and the mixture was stirred. In each run, 1% by weight of fatty acid diethanolamide and 8% by weight of ethanol were added together with water in an amount corresponding to the balance. Then, a substance shown in Table I, below, was added in the form of a powder and the pH of the composition was adjusted to a value of 6 to 8 by adding sodium hydroxide or sulfuric acid. With respect to each of the so obtained various liquid detergent compositions, corrosion of SUS 304 at dipping, 40° C. storage stability, 0° C. storage stability and perfume were evaluated to obtain results shown in Table I. In Table I, symbol "C" indicates an extreme change, symbol "B" indicates a slight change, and symbol "A" indicates no change. Incidentally, runs Nos. 1 through 3, 6 and 10 are comparative runs.

TABLE I

| Run No. | AOS (wt %) | AES* (wt %) | AAO (wt %) | KCl (wt %) | Additives | | Corrosion State (stored at 40° C.) 1 month | 6 months | 40° C. Storage Stability (1 week) | 0° C. Storage Stability (1 week) | Perfume | General Evaluation |
|---|---|---|---|---|---|---|---|---|---|---|---|---|
| | | | | | | Amount (wt %) | | | | | | |
| 1 | 5 | 5 | 1 | 3 | None | — | C | C | — | — | — | Poor |
| 2 | 10 | 5 | 5 | 3 | BHT** | 0.1 | C | C | — | — | — | Poor |
| 3 | 20 | 15 | 10 | 5 | BHT** | 0.5 | C | C | — | — | — | Poor |
| 4 | 10 | 10 | 5 | 2 | $Na_2HPO_4$ | 0.6 | A | A | B | A | A | Good |
| 5 | 10 | 10 | 5 | 2 | $NaHSO_3$ | 0.08 | A | A | A | A | A | Excellent |
| 6 | 10 | 15 | 5 | 2 | $Na_2SO_3$ | 0.02 | B | C | — | — | — | Poor |
| 7 | 10 | 15 | 5 | 2 | $Na_2SO_3$ | 0.06 | A | A | A | A | A | Excellent |
| 8 | 10 | 15 | 5 | 2 | $Na_2SO_3$ | 0.5 | A | A | A | A | A | Excellent |
| 9 | 10 | 10 | 5 | 2 | $Na_2SO_3$ | 1.0 | A | A | A | A | A | Excellent |
| 10 | 15 | 10 | 10 | 5 | $Na_2SO_3$ | 1.8 | A | A | A | C | B | Poor |
| 11 | 5 | 5 | 1 | 1 | $NaHSO_3$ | 0.05 | A | A | A | A | A | Excellent |
| 12 | 10 | 5 | 5 | 3 | $Na_2SO_3$ | 0.2 | A | A | A | A | A | Excellent |
| 13 | 5 | 15 | 5 | 1 | $Na_2SO_3$ | 0.08 | A | A | A | A | A | Excellent |
| 14 | 10 | 10 | 5 | 2 | $Na_2S_2O_3$ | 0.1 | A | A | A | A | B | Good |
| 15 | 15 | 10 | 10 | 3 | $Na_2SO_3$ | 0.2 | A | A | A | A | A | Excellent |

Note
*$\bar{p}$ = 3 in runs Nos. 1 through 10 and $\bar{p}$ = 5 in runs Nos. 11 through 15
**dibutylhydroxytoluene

We claim:

1. In a non-corrosive liquid detergent composition comprising, based on the total weight of the composition, 5 to 40% by weight of an anionic surface active agent, 1 to 10% by weight of an amine oxide represented by the following general formula:

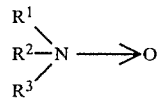

wherein $R^1$ stands for a linear or branched alkyl group having 10 to 20 carbon atoms, and $R^2$ and $R^3$ each stand for a methyl or ethyl group, and 0.5 to 5% by weight of an alkali metal chloride, the improvement comprising adding 0.04 to 1.5% by weight of at least one inorganic salt selected from the group consisting of sulfites and thiosulfates to the composition, based on the total weight of the composition.

2. A liquid detergent composition according to claim 1, wherein the inorganic salt is an alkali metal salt.

3. A liquid detergent composition according to claim 2 wherein the alkali metal salt is a compound selected from the group consisting of $NaHSO_3$, $Na_2SO_3$, $KHSO_3$, $K_2SO_3$, $Na_2S_2O_3$ and $K_2S_2O_3$.

4. A liquid detergent composition according to claim 1, wherein the amount of the inorganic salt is in the range of from 0.04 to 0.5% by weight.

5. A liquid detergent composition according to claim 1, wherein the anionic surface active agent is at least one compound selected from the group consisting of sodium, potassium, magnesium and triethanolamine salts, of sulfonates of an α-olefin, an internal olefin or a vinylidene-type olefin, said olefins having 10 to 20 carbon atoms; polyoxyethylene alkyl ether sulfates ($\bar{p}=0.5$ to 10), the alkyl group having 8 to 18 carbon atoms; alkylbenzenesulfonates, the alkyl group having 9 to 15 carbon atoms; and alkanesulfonates having 10 to 20 carbon atoms.

6. A liquid detergent composition according to claim 1 or 5, wherein the amount of the anionic surface active agent is in the range of from 10 to 35% by weight.

* * * * *